US007721388B2

(12) United States Patent
Lee

(10) Patent No.: US 7,721,388 B2
(45) Date of Patent: May 25, 2010

(54) DOOR HINGE

(75) Inventor: June Young Lee, Busan (KR)

(73) Assignee: Poong Won Industry Co., Ltd. (KR)

( * ) Notice: Subject to any disclaimer, the term of this patent is extended or adjusted under 35 U.S.C. 154(b) by 783 days.

(21) Appl. No.: 11/592,942

(22) Filed: Nov. 3, 2006

(65) Prior Publication Data

US 2007/0101542 A1 May 10, 2007

(30) Foreign Application Priority Data

Nov. 4, 2005 (KR) ..... 10-2005-105284

(51) Int. Cl.
*E05F 1/08* (2006.01)

(52) U.S. Cl. ..... 16/286; 16/322

(58) Field of Classification Search ..... 16/286, 16/289, 290, 292, 321, 322; 49/386, 387, 49/389, 398, 402; 126/190, 191, 192, 194
See application file for complete search history.

(56) References Cited

U.S. PATENT DOCUMENTS 2,579,091 A * 12/1951 Rinaldo ..... 16/245
2,823,662 A * 2/1958 Aylor ..... 126/191
3,299,879 A * 1/1967 Doner ..... 126/194
4,163,344 A * 8/1979 Scherer ..... 49/386
7,017,232 B1 * 3/2006 Priddy ..... 16/286
2003/0172920 A1 * 9/2003 Gronbach ..... 126/197
2004/0172787 A1 * 9/2004 Collene et al. ..... 16/289
2005/0125951 A1 * 6/2005 Hao ..... 16/340
2005/0155181 A1 * 7/2005 Habegger et al. ..... 16/297

* cited by examiner

*Primary Examiner*—Chuck Y. Mah
(74) *Attorney, Agent, or Firm*—Park & Associates IP Law LLC

(57) ABSTRACT

Provided is a door hinge. The door hinge includes a fixing member, an activating member, a guide pin, and a guide frame. The fixing member is installed at a door frame. The activating member is installed at a door, and connects with the fixing member by a hinge, and opens and closes the door. The guide pin is fitted into guide holes provided at both sides of the activating member, and elastically moves up/down along the guide hole by a tension force of a spring installed inside the activating member. A guide frame is combined to the guide pin, and connects at its lower end with the fixing member by a pin, and rotates about the pin depending on an operation of the activating member. The guide hole is round (R) shaped at its center, and has a curved shape in entirety.

7 Claims, 6 Drawing Sheets

DOOR HINGE

FIELD OF THE INVENTION

The present invention relates to a door hinge, and more particularly, to a door hinge for allowing an opening/closing operation of a door with less force.

BACKGROUND OF THE INVENTION

As well known in the art, a door hinge refers to an apparatus designed to allow a door to be opened/closed on a door frame. The door hinge is divided as a door hinge constructed to open and close the door in a left/right opening/closing method starting from one side, and a door hinge constructed to open and close the door in an up/down opening/closing method (that is, a lying down in front and coming out method) starting from an upper end.

The latter door hinge is used for a door of a gas oven or microwave oven that is electric home appliances. A conventional construction of the door hinge is shown in FIG. 1.

As shown in FIG. 1, the conventional door hinge 150 includes a fixing mount 110 installed at a door frame 100; and an activating mount 112 installed at the door 200, connecting by a hinge 126 with the fixing mount 110, rotating about the hinge 126, and opening and closing the door 200.

A guide unit 114 is provided between the fixing mount 110 and the activating mount 112, and guides an opening/closing operation of the door 200.

The guide unit 114 includes a connection plate 116 installed at the fixing mount 110; a rotation plate 120 connecting by a pin 118 with the connection plate 116 and rotating about the pin 118; and a guide pin 124 combining to a front end of the rotation plate 120 and moving up/down along the guide hole 122 provided at both side surfaces of the activating mount 112.

In the above constructed guide unit 114, when the activating mount 112 is rotated, the guide pin 124 vertically moves down along the guide hole 122 and at the same time, the rotation plate 118 connecting to the guide pin 124 rotates about the pin 118 depending on the movement of the guide pin 124 and guides the rotation of the activating mount 112. Thus, the door 200 can stably perform an opening operation.

However, the conventional door hinge 150 is expected to have drawbacks below in use.

First, there is a drawback in that, if the guide hole 122 is manufactured to have a straight-line shape as shown, a force is much needed in opening the door 200. In other words, due to a characteristic that the door 200 rotates about the hinge 126 and is lain down in front and opened, the door 200 pulls the guide pin 124 in its opening. Owing to the straight-line shape of the guide hole 122, the guide pin 124 strongly contacts with one side surface of the guide hole 122 by a pulling force of the door 200 in its movement, thereby generating a frictional force. This frictional force limits the guide pin 124 in its vertical movement, thereby causing a drawback of much needing the force in opening the door 200.

Further, it is required to open and stop the door 200 at a predetermined angle so as to check food in cooking, but there is a drawback that the conventional door hinge 150 is not provided with means for stopping the door 200 at a predetermined angle.

SUMMARY OF THE INVENTION

Accordingly, the present invention is directed to a door hinge that substantially overcomes one or more of the limitations and disadvantages of the conventional art.

One object of the present invention is to provide a door hinge for opening a door by less force.

Another object of the present invention is to provide a door hinge for, after opening a door at a predetermined angle, automatically keeping a still state of the door.

A further another object of the present invention is to provide a door hinge for, after fully opening a door, supporting the door and preventing a collision against the ground.

A yet another object of the present invention is to provide a door hinge for, after closing a door, firmly compressing the door to a door frame.

A still another object of the present invention is to provide a door hinge for minimizing the occurrence of a noise at the time of opening/closing a door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims as well as the appended drawings.

To achieve the above and other objects and advantages, and in accordance with the purpose of the invention, as embodied and broadly described herein, there is provided a door hinge including a fixing member, an activating member, a guide pin, and a guide frame. The fixing member is installed at a door frame. The activating member is installed at a door, and connects with the fixing member by a hinge, and opens and closes the door. The guide pin is fitted into guide holes provided at both sides of the activating member, and elastically moves up/down along the guide hole by a tension force of a spring installed inside the activating member. A guide frame is combined to the guide pin, and connects at its lower end with the fixing member by a pin, and rotates about the pin depending on an operation of the activating member. The guide hole is round (R) shaped at its center, and has a curved shape in entirety.

The guide hole may be further provided at its upper part with an inclination part inclined oppositely to a central round part.

A plate spring may be attached to one side surface of the activating member, and may be provided at its center with an elastic protrusion. The elastic protrusion is selectively locked by any one of first and second locking jaws provided at one side surface of the guide frame, and restricts the rotation of the guide plate.

The guide frame further may include, at its one side and lower end, a third locking jaw for locking a reinforcement pin provided at a lower end of the activating member.

The hinge may be provided at its one end with a square jaw, and any one of connection through-holes, into which the hinge is fitted, of the activating member may be square shaped corresponding to the square jaw.

Primary opening to be referred in the present invention refers to a state where the door is stretched by about 15° on the door frame so as to check a cooking state of food. Secondary opening refers to a state where the door is lain down and opened by about 90° on the door frame so as to take out the completely cooked food.

It is to be understood that both the foregoing summary and the following detailed description of the present invention are merely exemplary and intended for explanatory purposes only.

BRIEF DESCRIPTION OF THE DRAWINGS

The accompanying drawings, which are included to aid in understanding the invention and are incorporated into and constitute a part of this application, illustrate embodiment(s) of the invention and together with the description serve to explain the principles of the invention. In the drawings:

FIG. 1 illustrates a structure of a conventional door hinge;

DETAILED DESCRIPTION OF THE DRAWINGS

Figure 1:
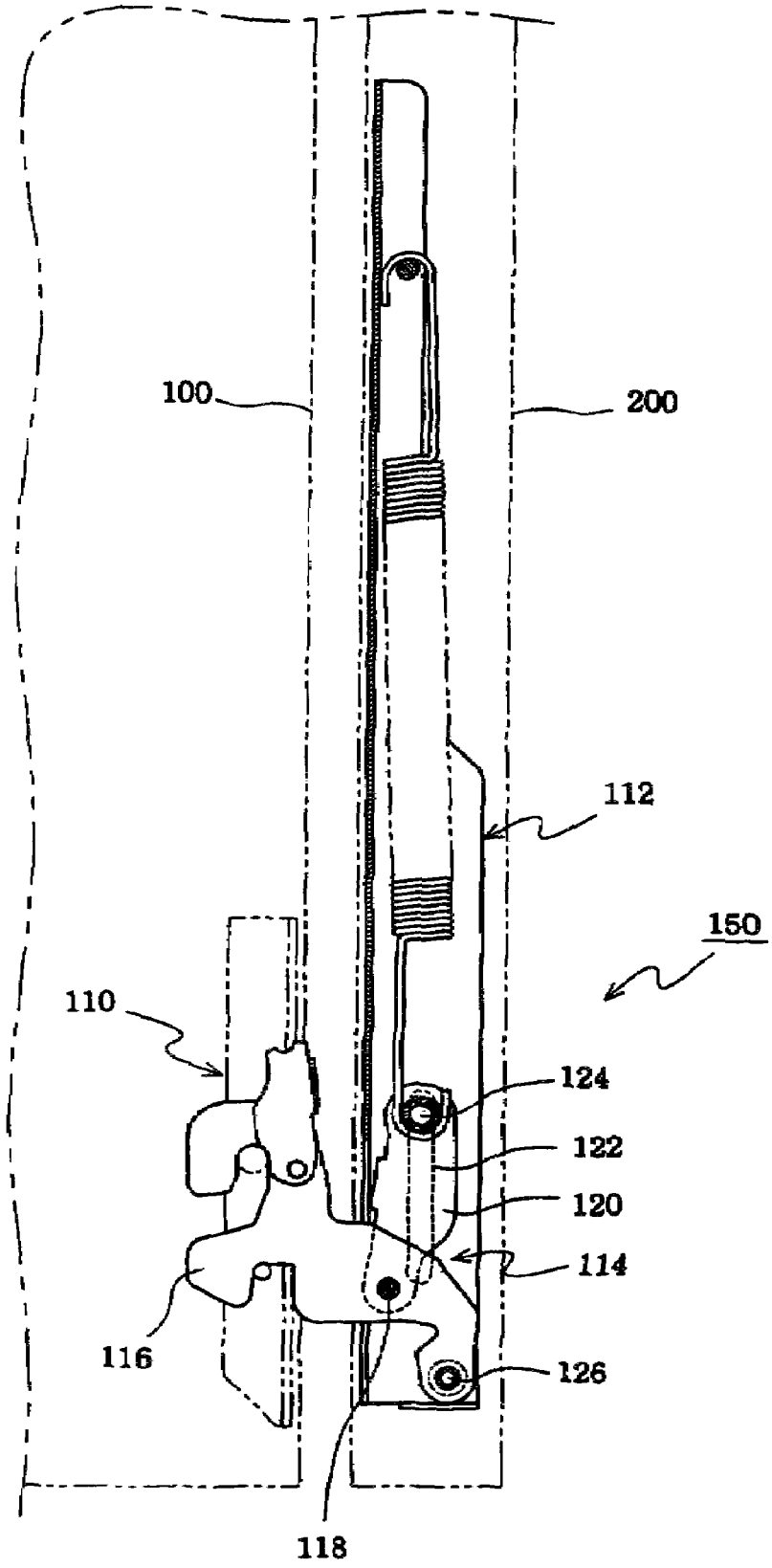
FIG. 1 (PRIOR ART)
FIG. 1 is

Reference will now be made in detail to the preferred embodiments of the present invention, examples of which are illustrated in the accompanying drawings. Wherever possible, the same reference numerals will be used throughout the drawings to refer to the same or like parts.

Figure 2:
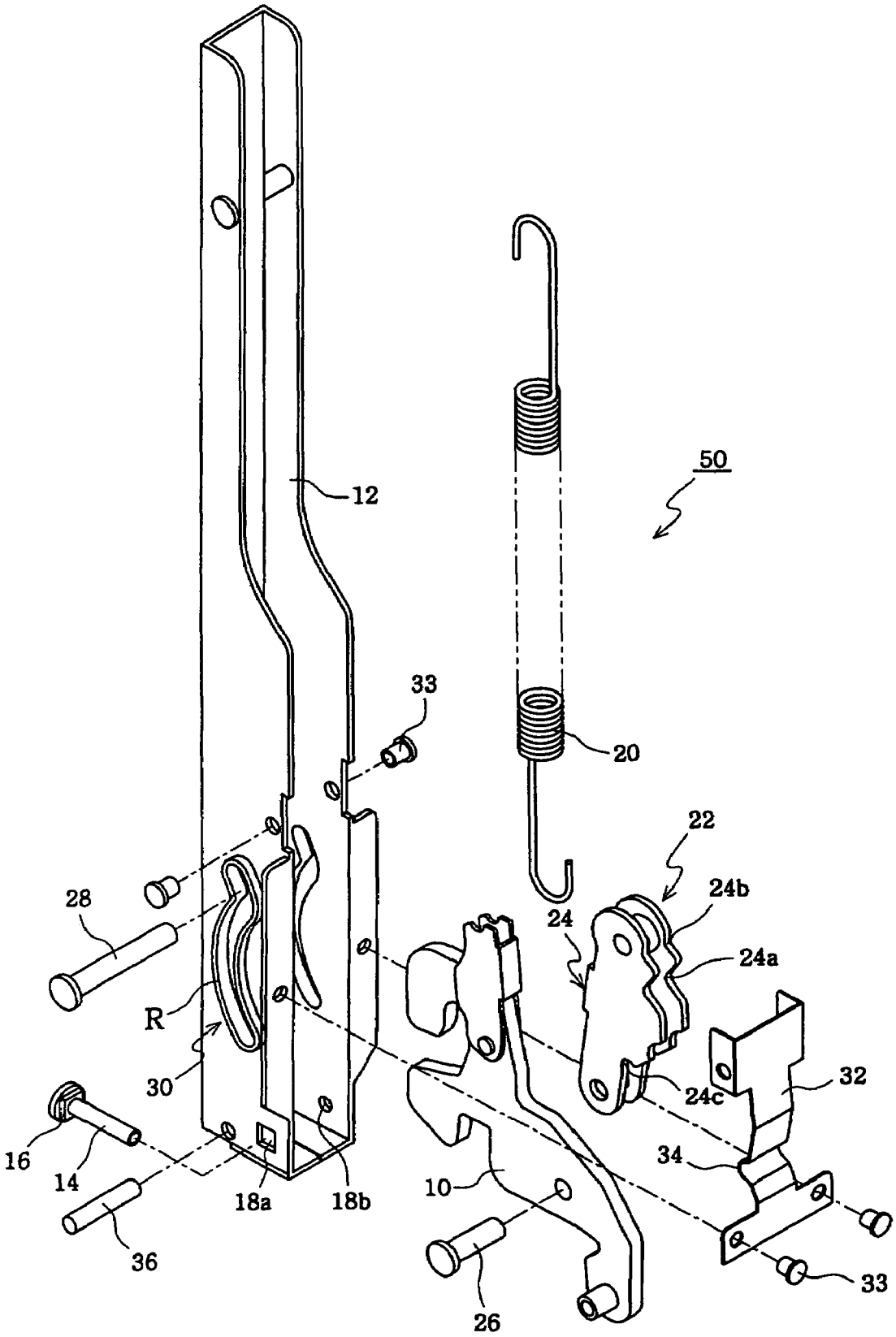
FIG. 2 is an exploded perspective view illustrating a construction of a door hinge according to the present invention.
Figure 3:
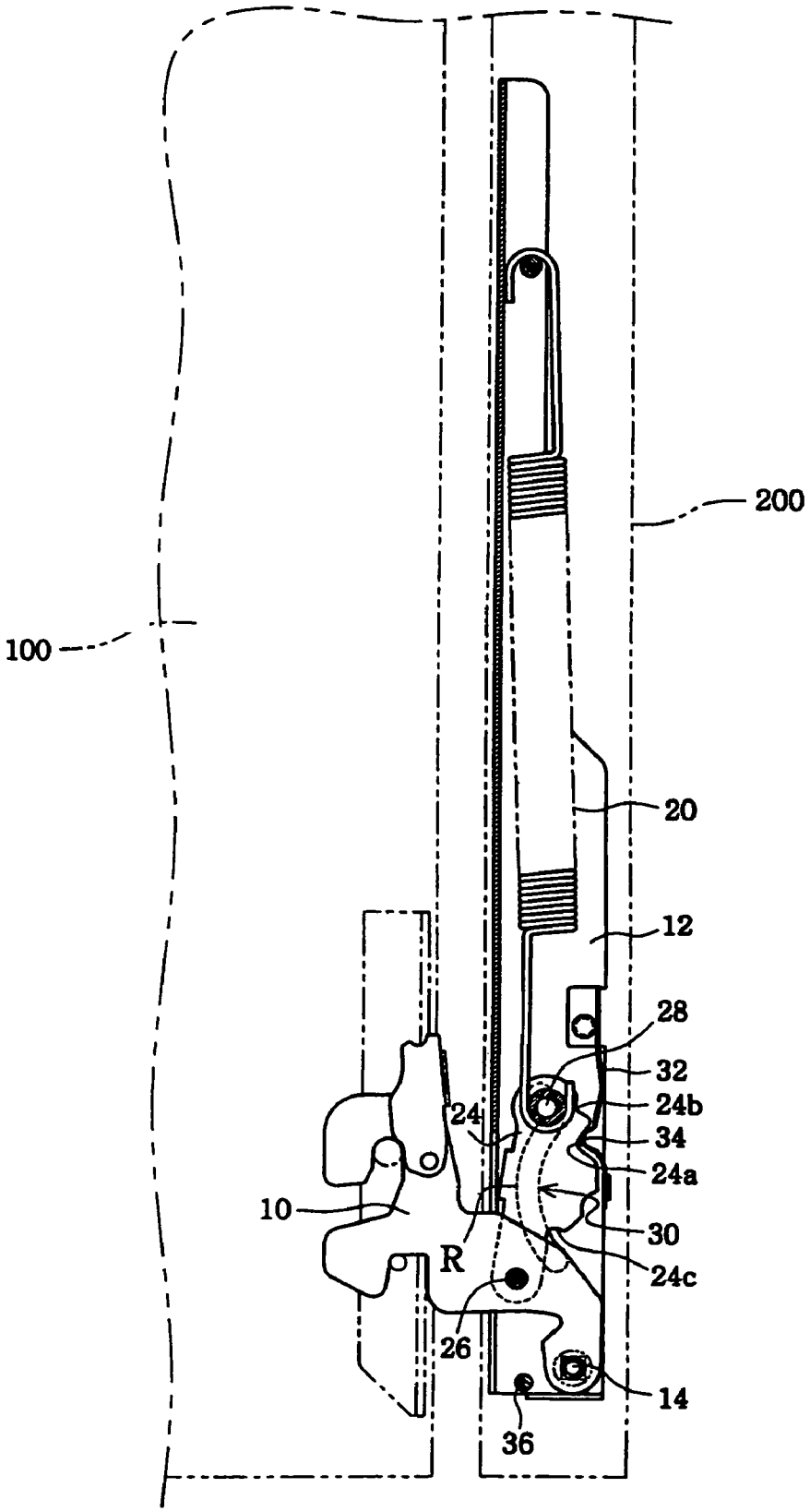
FIG. 3 is a side view illustrating an assembly structure of a door hinge shown in FIG. 2.
Figure 4:
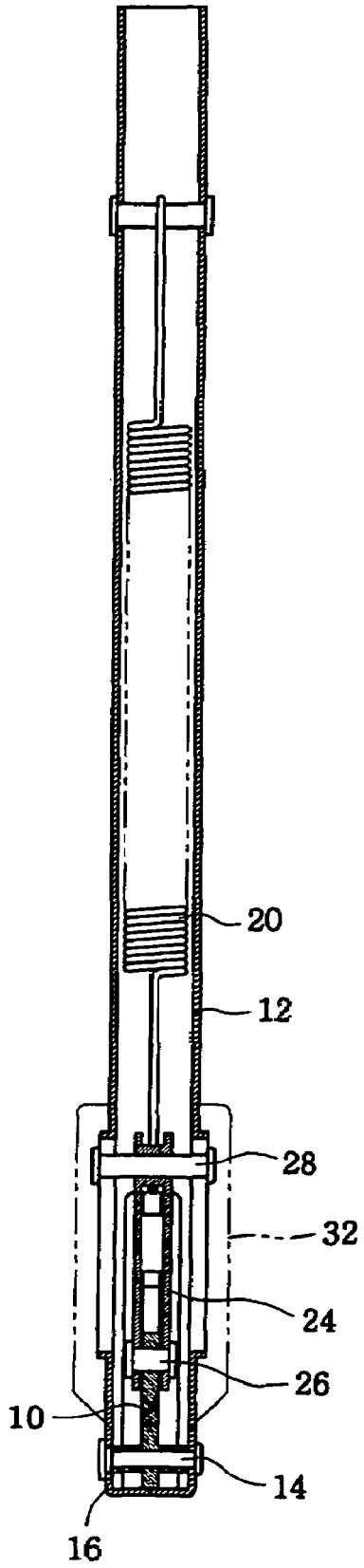
FIG. 4 is a front view of FIG. 3.

FIGS. 2 to 4 illustrate a construction of a door hinge according to the present invention.

As shown, the door hinge 50 is greatly divided as a fixing member 10 and an activating member 12.

The fixing member 10 is installed at a door frame 100, and supports each constituent part of the door hinge 50.

The activating member 12 is installed at a door 200. The activating member 12 connects by a hinge 14 to the fixing member 10, and rotates about the hinge 14, and opens or closes the door 200. The hinge 14 is provided at its one end with a square jaw 16. It is desirable that any one 18*a* of connection through-holes 18*a* and 18*b*, into which the hinge 14 is fitted, of the activating member 12 is square shaped corresponding to the square jaw 16. This is to, when the activating member 12 rotates, allow the hinge 14 not to rotate by the square jaw 16 of the hinge 14 and the square-shaped connection through-hole 18*a*, with the hinge 14 fitted into the connection through-holes 18*a* and 18*b*, thereby preventing the occurrence of a noise caused by a friction between the connection through-holes 18*a* and 18*b* and the hinge 14.

A spring 20 is installed inside the activating member 12. The spring 20 connects at its one end to the activating member 12 and connects at the other end to a guide pin 28, and provides a tension force based on a proper pressure such that the guide pin 28 elastically moves up/down.

A guide unit 22 is installed between the fixing member 10 and the activating member 12, and guides an operation of the activating member 12.

The guide unit 22 includes a guide frame 24, the guide pin 28, and a guide hole 30.

In state where the fixing member 10 connects with the pin 26, the guide frame 24 rotates about the pin 26 depending on a rotation operation of the activating member 12. The guide frame 24 is combined at its front end with the guide pin 28 that moves up/down along the guide hole 30. The guide frame 24 is provided at its one side surface with a plurality of first and second locking jaws 24*a* and 24*b* that are spaced a predetermined distance apart. The first and second locking jaws 24*a* and 24*b* are selectively locked by an elastic protrusion 34 of a plate spring 32 to be described later. The first and second locking jaws 24*a* and 24*b* restrict a rotation of the activating member 12 and thus, restrict an opening of the door 200. The guide frame 23 is further provided at its lower end with another third locking jaw 24*c*. When the door 200 is completely opened and is lain down in front, the third locking jaw 24*c* is locked by a reinforcement pin 36 provided at a lower end of the activating member 12, thereby supporting the opened door 200 and preventing the door from colliding against the ground.

The guide pin 28 refers to a pin for, when the activating member 12 rotates to open the door 200, moving up/down along the guide hole 30, and guiding the rotation operation of the activating member 12. The guide pin 28 is combined to a front end of the guide frame 24, and is fitted into the guide hole 30 provided at both side surfaces of the activating member 12, thereby connecting the guide frame 24 with the activating member 12.

As described above, the guide hole 30 is provided by passing through both side surfaces of the activating member 12, and guides the up/down movement of the guide pin 28. The guide hole 30 is rounded at its center, and has a curve shape in entirety. This is to allow the opening and closing operation of the door 200 by less force.

In other words, in the guide hole 30 having the most ideal shape, preferably as shown in FIG. 2, a force of the spring 20 should be necessarily designed on the basis of "$\chi \cdot \sin\theta$" such that the guide hole 30 is rounded (R) and preferably has the curved shape in entirety. This Equation of "$\chi \cdot \sin\theta$" will be easily understood by a detailed description below.

1) A torque acting on a rotation direction of the door within an operation range (θ: 0° to 90°) of the door is expressed by a product of a component sin θ of a load and a distance (r) from a rotation center below:

$$\text{Rotation Torque}(\theta) = \int_0^r m(r)\cdot g\cdot \sin\theta \cdot r dr = \int_0^r m(r)\cdot r dr \times g \times \sin\theta$$

$$\int_0^r m(r)\cdot r dr \times g \times \sin\theta \text{ is constant depending on a door.}$$

2) In a conventional method, a force by a spring inside a hinge is expressed below depending on an opening angle of a door:

$$F = k_x \times \chi(\theta) = k_x \times (\chi_0 + k_\theta \cdot \theta)$$

$k_x$: spring constant, and $k_x(\chi_0 + k_\theta \cdot \theta)$: variable.

Thus, the force (F) has a linear format.

In other words, in the conventional method, the force by the door and the force by the spring cannot be consistent, and this causes unbalance in force when the door is activated (opened and closed) and thus, is against nature.

When two forces are exactly consistent, the most ideal state becomes the most excellent state and thus, the force by the spring should be designed to have a "$\chi \cdot \sin\theta$" format.

Accordingly, in the present invention, the force by the spring is expressed by Equation below and thus, can be designed closely to an ideal state:

$$F = k_x \times \chi(\theta) = k_x \times (\chi_0 + \chi \cdot \sin\theta)$$

$\chi_0$: initial position, and $\chi$: distance variation of the door depending on angle at the time of opening the door.

Meantime, the plate spring 32 is attached to one surface of the activating member 12 by a connection unit 33 such as a rivet. The plate spring 32 pressurizes the guide frame 24 by its tension force, restricts the rotation of the activating member 12, and selectively stops opening the door 200. In detail, the elastic protrusion 34 is protruded and provided at a center of the plate spring 32. The elastic protrusion 34 is selectively locked by any one of the first and second locking jaws 24*a* and 24*b* provided at one side surface of the guide frame 24. In other words, when the elastic protrusion 34 is locked by the first locking jaw 24*a* of the guide frame 24, the door 200 is in a closed state. When the elastic protrusion 34 is locked by the first locking jaw 24*a*, it pressurizes the guide frame 24 by the tension force of the plate spring 32, thereby restricting the rotation of the activating member 12 and restricting the arbitrary opening of the closed door 200. If the door 200 is pulled by a force larger than the tension force of the plate spring 32 and is primarily opened, the elastic protrusion 34 is unlocked from the first locking jaw 24*a* of the guide frame 24 and then, is locked by the second locking jaw 24*b*. When the door 200 is free from pulling, the tension force of the plate spring 32 again acts, and the elastic protrusion 34 pressurizes the guide frame 24 and restricts the rotation of the activating member 12, thereby keeping a still state of the primarily opened door 200.

The activating member 12 is provided at its lower end with the reinforcement pin 36 in penetration. When the door 200 is secondarily opened, that is, when the door 200 is lain down in front and is completely opened, the reinforcement pin 36 is locked by the third locking jaw 24*c* provided at the lower end of the guide frame 24, thereby supporting the secondarily opened door 200 and preventing a collision of the door 200 against the ground.

An operation of the above constructed door hinge according to the present invention will be described with reference to FIGS. 5 and 6 below.

First, in the inventive door hinge 50, its operation is divided as an operation of primarily opening the door 200 to check a cooking state of food and an operation of secondarily opening the door 200 to take out the completely cooked food.

Figure 5:
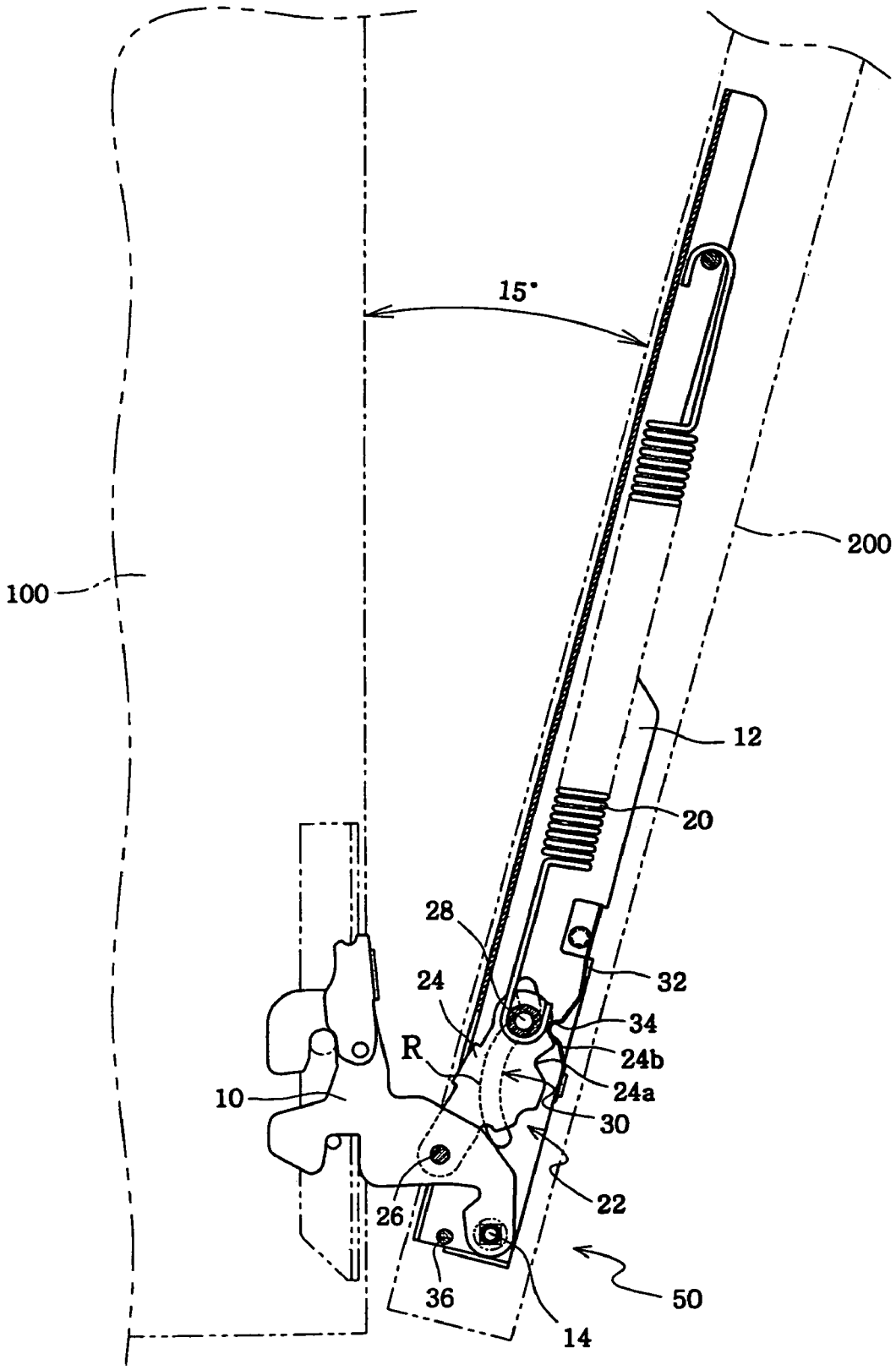
FIGS. 5 and 6 sequentially illustrate an operation of a door hinge according to the present invention.

FIG. 5 illustrates the operation of the door hinge 50 for primarily opening the door 200 according to the present invention. As shown, if the closed door 200 is pulled, the activating member 12 is rotated about the hinge 14. The guide pin 28 connecting the activating member 12 with the guide frame 24 elastically moves down along the guide hole 30 by the tension force of the spring 20 depending on the rotation of the activating member 12, and guides the rotation of the activating member 12.

After that, if the door 200 is opened by about 15°, its still state is automatically kept. In other words, when the activating member 12 is rotated, the elastic protrusion 34 of the plate spring 32 is unlocked from the first locking jaw 24*a* of the guide frame 24 and then, is locked by the second locking jaw 24*b*. If the door 200 is free from pulling, when the elastic protrusion 34 is locked by the second locking jaw 24*b*, it pressurizes the guide frame 24 by the tension force of the plate spring 32, thereby restricting the rotation of the activating member 12. Thus, the door 200 is primarily opened and then, its still state is automatically kept.

Figure 6:
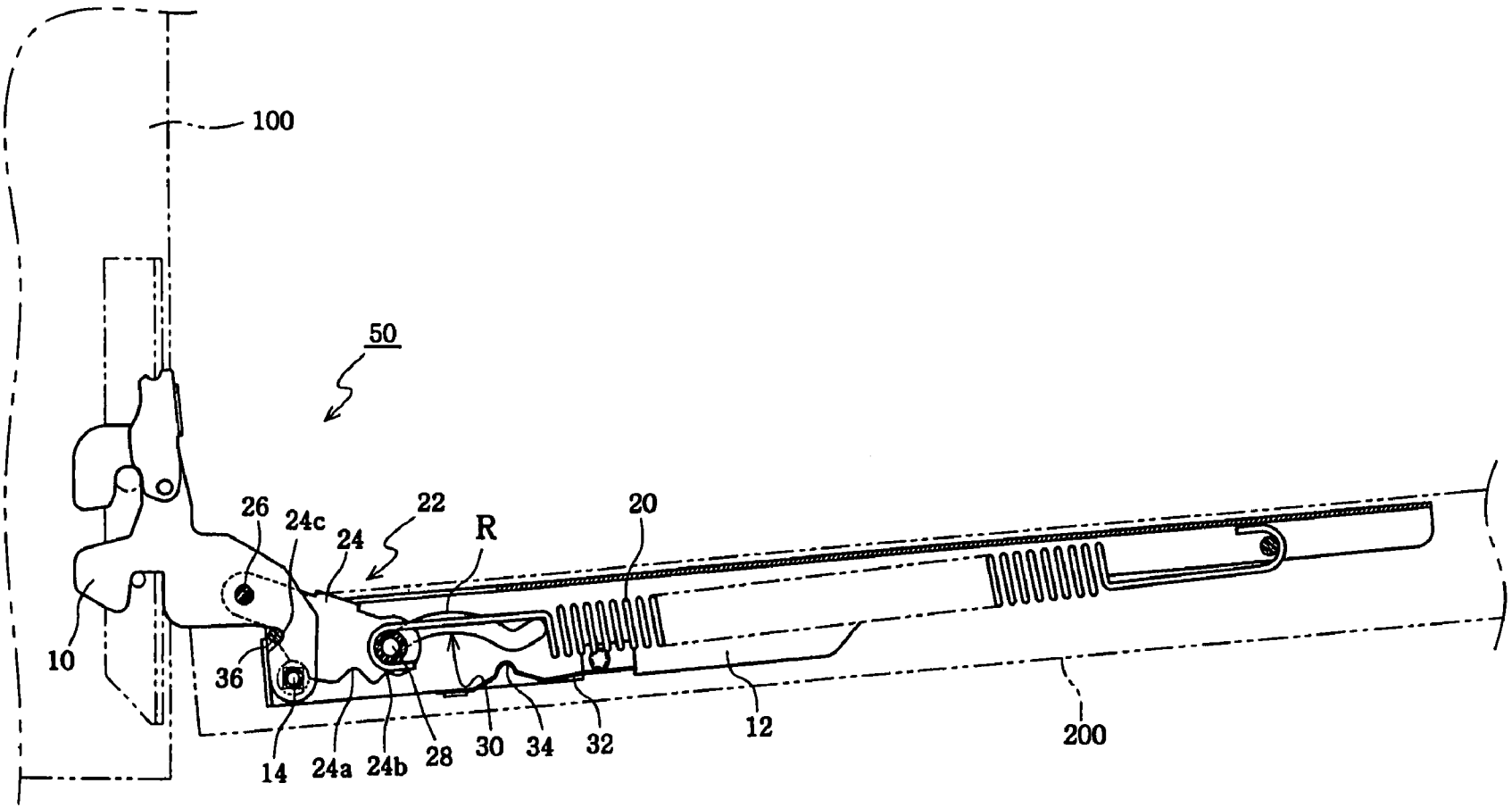

FIG. 6 illustrates the operation of the door hinge 50 for secondarily opening the primarily opened door 200. As shown, when the primarily opened door 200 is pulled by a force larger than the tension force of the plate spring 32, the elastic protrusion 34 is unlocked from the second locking jaw 24*b*. Thus, the activating member 12 is rotated about the hinge 14 freely from restriction.

At the same time of rotating the activating member 12, the guide pin 28 elastically moves down along the guide hole 30, and guides the rotation of the activating member 12. The guide pin 28 can smoothly move with less friction through a round part (R) of the guide hole 30, thereby open the door 200 by less force.

After that, if the door 200 is completely lain down in front and is secondarily opened, the reinforcement pin 36 provided for the activating member 12 is locked by the third locking jaw 24*c* of the guide frame 24 and thus, the door 200 is spaced a predetermined angle apart from the ground and is supported, and the door 200 is prevented from colliding against the ground.

As described above, the present invention achieves many effects as follows.

First, there is an effect in that the guide hole is rounded and curved-shaped, thereby opening the door by the less force.

Second, there is an effect in that after the door is primarily opened, its still state can be automatically kept, thereby providing a use convenience.

Third, there is an effect in that after the door is secondarily opened, the door is spaced a predetermined angle apart from the ground and is supported, and the door is prevented from colliding against the ground.

Fourth, there is an effect in that after the door is closed, the door can be firmly compressed to the door frame by the tension force of the plate spring.

Fifth, there is an effect in that the hinge does not run idle inside the connection through-hole of the activating member, thereby preventing the occurrence of the noise caused by the friction of the hinge and the connection through-hole at the time of opening and closing the door.

While the present invention has been described with reference to exemplary embodiments thereof, it will be apparent to those skilled in the art that various modifications can be made therein without departing from the spirit and scope of the invention as defined by the appended claims and their equivalents.

What is claimed is:

1. A door hinge comprising:

a fixing member coupled with a door frame;

an activating member coupled with a door, and connecting to the fixing member with a hinge for opening and closing the door, the activating member including a guide cam hole;

a guide pin received in the guide cam hole of the activating member, and elastically moving up and down along the guide cam hole by a tension force of a spring which is coupled with the activating member; and a guide frame coupled to the guide pin, and connecting with the fixing member via a pivot pin, and rotating about the pivot pin in response to an operation of the activating member;

wherein the guide cam hole has a curved contour;

wherein the door hinge further comprises a plate spring attached to one side of the activating member for restricting a rotational movement of the guide frame by a spring force of the plate spring.

2. The door hinge according to claim 1, wherein the plate spring includes an elastic protrusion configured to be selectively locked in first and second locking portions provided at one side surface of the guide frame to restrict a rotational movement of the door at selected positions.

3. The door hinge according to claim 2, wherein the guide frame further comprises, at its one side surface thereof, a third locking portion for locking a reinforcement pin provided at a lower end of the activating member to restrict the rotational movement of the door within a maximum operation angle of the door.

4. The door hinge according to claim 1, wherein the hinge is provided at its one end with a square jaw coupled to the activating member and configured to prevent a rotation of the hinge relative to the activating member.

5. The door hinge according to claim 1, wherein the guide cam hole is shaped such that a force (F) by the spring is determined by the following equation of:

$$F=K_x(X_0+X\cdot\sin\theta),$$

wherein $K_x$ is a spring constant of the spring, $X_0$ is an initial position of the spring, X is a displaced position of the spring where the door is at an operated position, and θ is an operation angle of the door where the door is at the operated position.

6. The door hinge according to claim 1, wherein the activating member is shaped to have a pair of parallel plate parts, and the activating member has a pair of guide cam holes of same shape, one hole disposed at one of the parallel plate parts and the other hole disposed at a corresponding location of the other one of the parallel plate parts, and wherein the guide pin is received in the pair of guide cam holes.

7. The door hinge according to claim 6, wherein the spring is placed in a space between the pair of parallel plate parts, with one end of the spring coupled to an upper portion of the activating member and the other end of the spring coupled to the guide pin.

* * * * *